US007101586B2

(12) United States Patent
Raina

(10) Patent No.: US 7,101,586 B2
(45) Date of Patent: Sep. 5, 2006

(54) METHOD TO INCREASE THE EMISSION CURRENT IN FED DISPLAYS THROUGH THE SURFACE MODIFICATION OF THE EMITTERS

(75) Inventor: Kanwal K. Raina, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 187 days.

(21) Appl. No.: 10/120,511

(22) Filed: Apr. 12, 2002

(65) Prior Publication Data

US 2002/0136830 A1 Sep. 26, 2002

Related U.S. Application Data

(63) Continuation of application No. 09/387,776, filed on Sep. 1, 1999, now abandoned.

(51) Int. Cl.
*B05D 5/12* (2006.01)
*B05D 5/06* (2006.01)

(52) U.S. Cl. ..... 427/77; 445/24

(58) Field of Classification Search ..... 427/77; 445/24

See application file for complete search history.

(56) References Cited

U.S. PATENT DOCUMENTS 4,411,734 A * 10/1983 Maa ..... 438/655
4,624,737 A * 11/1986 Shimbo ..... 257/353
4,642,620 A * 2/1987 Togashi et al. ..... 345/214
5,186,670 A * 2/1993 Doan et al. ..... 445/24
5,199,917 A * 4/1993 MacDonald et al. ..... 445/24
5,210,472 A 5/1993 Casper et al.
5,658,710 A * 8/1997 Neukermans ..... 430/320
5,747,384 A * 5/1998 Miyamoto ..... 438/685
5,808,400 A 9/1998 Liu
5,825,126 A 10/1998 Kim
5,853,492 A * 12/1998 Cathey et al. ..... 134/3
5,869,169 A 2/1999 Jones
5,888,906 A * 3/1999 Sandhu et al. ..... 438/706
5,917,213 A * 6/1999 Iyer et al. ..... 257/309
5,989,999 A * 11/1999 Levine et al. ..... 438/627
6,086,442 A * 7/2000 Sandhu et al. ..... 445/24

OTHER PUBLICATIONS

John H. Das et al., "Low Work Function Addressable Silicon Field Emission Single Cathode With Integrated Lateral Feedback Resistor and Suspended Heater", School of Electrical Engineering, pp. 47-51.*
W.A. Mackie, "Work Function Measurements of Diamond Film Surfaces", Linfield Research Institute, pp. 2041-2045.
Qing-An Huang et al., "The Advantages of N-Type Heavily-Doped Silicon as an Emitter for Vacuum Microelectronics" 9th International Vacuum Microelectronics Conference, 1996, pp. 155-157.*
B.C. Djubua et al., "Emission Properties of Spindt-Type Cold Cathodes With Different Emission Cone Material", IEEE Transactions on Electron Device, vol. 38, No. 10, Oct. 1991, pp. 2314-2316.*
Qi-Lue Chen et al., "Investigation of Electron Tunnelling Emitter", Beijing Vacuum Electronics Research Institute, pp. 488-490.*
J. Ishikawa et al, "Cone-Shaped Metal Insulator Semiconductor Cathode for Vacuum Microelectronics", Dept. of Electronic Science and Engineering, Japan, pp. 1970-1972.

* cited by examiner

*Primary Examiner*—Michael Cleveland
(74) *Attorney, Agent, or Firm*—Dickstein Shapiro LLP

(57) ABSTRACT

A system and method for fabricating a FED device is disclosed. The system and method provide for use of PECVD hydrogenation followed by nitrogen plasma treatment of the tip of the current emitter of the FED device. The use of this process greatly reduces the native oxides in the tip of the current emitter. Such native oxides function as undesirable insulators degrading current emission. By reducing the amount of oxides in the tip, this invention provides for an increase in the current emission of the FED device.

12 Claims, 6 Drawing Sheets

| SAMPLE | O | N | Si |
|---|---|---|---|
| 1 (WITHOUT SURFACE TREATMENT) | 32.5 | 0.0 | 63.4 |
| 2 (WITH SURFACE TREATMENT) | 20.9 | 33.9 | 34.7 |

FIG. 4

METHOD TO INCREASE THE EMISSION CURRENT IN FED DISPLAYS THROUGH THE SURFACE MODIFICATION OF THE EMITTERS

This application is a continuation application of U.S. patent application Ser. No. 09/387,776 filed Sep. 1, 1999 now abandoned the entirety of which is incorporated herein by reference.

BACKGROUND OF THE INVENTION

I. Field of the Invention

The present invention relates generally to display devices implementing Field Emission Display (FED) technology. More specifically, the invention relates to a method for increasing the emission current of the current emitters of a Field Emission Display (FED).

II. Description of the Related Art

Until recently, the cathode ray tube ("CRT") had been the primary device for displaying information. While having sufficient display characteristics with respect to color, brightness, contrast, and resolution, CRT's are relatively bulky and consume large amounts of power. In view of the advent of portable laptop computers, the demand has intensified for a display technology which is light-weight, compact, and power efficient.

One available technology is flat panel displays, and more particularly, Liquid Crystal Display ("LCD") devices. LCDs are currently used for laptop computers. However, these LCD devices provide poor contrast in comparison to CRT technology. Further, LCDs offer only a limited angular display range. Moreover, color LCD devices consume power at rates incompatible with extended battery operation. Lastly, a color LCD type screen tends to be far more costly than an equivalent CRT.

FED technology has recently come into favor as one technology for developing low power, flat panel displays. This technology uses an array of cold cathode emitters and cathodoluminescent phosphors for conversion of energy from an electron beam into visible light. Part of the desire to use FED technology for flat panel displays is that such technology is conducive to producing flat screen displays having high performance, low power and light weight.

In FED structures and devices a plurality (array) of microelectronic emission elements are employed to emit a flux of electrons from the surface of the emission element(s). The emitter surface, referred to as a "tip", is specifically shaped to facilitate effective emission of electrons, and may for example be conical, pyramidal, or ridge-shaped in surface profile, or alternatively the tip may comprise a flat emitter surface of low work function material.

In the construction of FED current emitters, various materials are deposited onto a substrate to form the device. Thereafter, a panel containing spaced phosphors is sealed to a panel containing the emitters under conditions where the temperature is approximately 400 degrees Celsius. When the material used to construct the FED current emitter tip, an amorphous silicon doped with boron or phosphorus, is deposited, native oxides form on the tip due to exposure to the atmosphere. This change in the chemical nature of the tip results in an increased work function yielding a decrease in the current emission of the tip nearly ten fold. As a general principal the work function is an instrumental factor in the resulting current emission. The practical effect is the manifestation of a display which is dimmer than that desired or expected, often resulting in an increase in power usage in order to try to achieve a brighter display.

SUMMARY OF THE INVENTION

The present invention relates to a system and method for increasing the emission current of the current emitters of a FED device by removing native oxygen from silicon deposited on the tip of the FED device through PECVD hydrogenation and subsequently incorporating nitrogen onto the surface without exposing the tip to the atmosphere.

In the invention an amorphous silicon tip doped with boron or phosphorus is subjected to PECVD hydrogenation followed by an infusing nitrogen plasma, preferably a $NH_3$ plasma, which deposits onto the tip surface, while the FED structure is still in the PECVD chamber. PECVD hydrogenation removes oxides from the silicon surface by infusing hydrogen. The result is the tip being free of approximately one third of the native oxides, which formed when the tip was exposed to atmospheric conditions and which would have otherwise remained on the tip increasing the work function and yielding a less than desirable emission current. The nitrogen plasma treatment is used to complete the process. After the PECVD and nitrogen plasma treatment, the FED structure is sealed in a vacuum under high temperature.

BRIEF DESCRIPTION OF THE DRAWINGS

The foregoing and other advantages and features of the invention will become more apparent from the detailed description of preferred embodiments of the invention given below with reference to the accompanying drawings in which:

FIG. 4 is a chart comparing the present invention to the prior art in terms of oxygen, nitrogen and silicon present in the FED tip after fabrication;

DETAILED DESCRIPTION OF PREFERRED EMBODIMENTS

Figure 1:
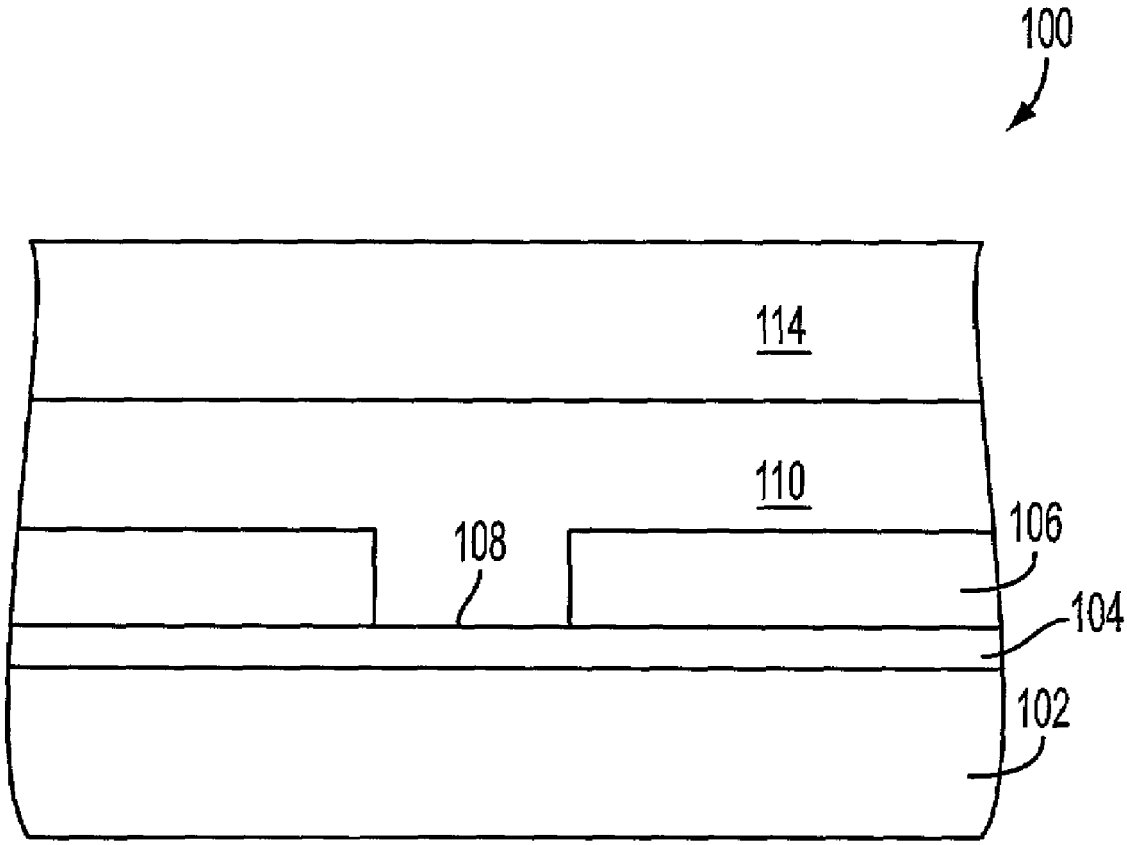
FIG. 1 is a cross sectional view of the material composition of a FED device in accordance with a preferred embodiment of this invention at an early stage of processing.

Referring now to the drawings, where like reference numerals designate like elements. FIG. 1 is a representative cross-section of a FED device 100. FED device 100 contains a substrate 102 made of glass upon which the materials making up the functional part of the FED device are deposited. The glass substrate 102 often contains impurities such as sodium, therefore, a "barrier film" 104, in this instance silicon dioxide ($SiO_2$), is deposited on top of the substrate 102 as an insulator. This barrier film 104 is deposited using PECVD processing. Next, a conductive metal layer 106 is deposited in a desired pattern on top of the barrier film 104. This conductive metal layer 106 is formed preferably of an aluminum alloy which may contain chromium. This conductive metal layer 106 is patterned to form vacant areas 108 where the conductive metal layer 106 does not cover the barrier layer 104. These vacant areas 108 will hold the base of a later formed FED tip. After conductive metal layer 106 is formed, a layer of amorphous silicon doped with boron 110 is deposited followed by the deposition of a layer of amorphous silicon doped with phosphorus 114. Layers 110 and 114 are deposited using PECVD processing.

Figure 2:
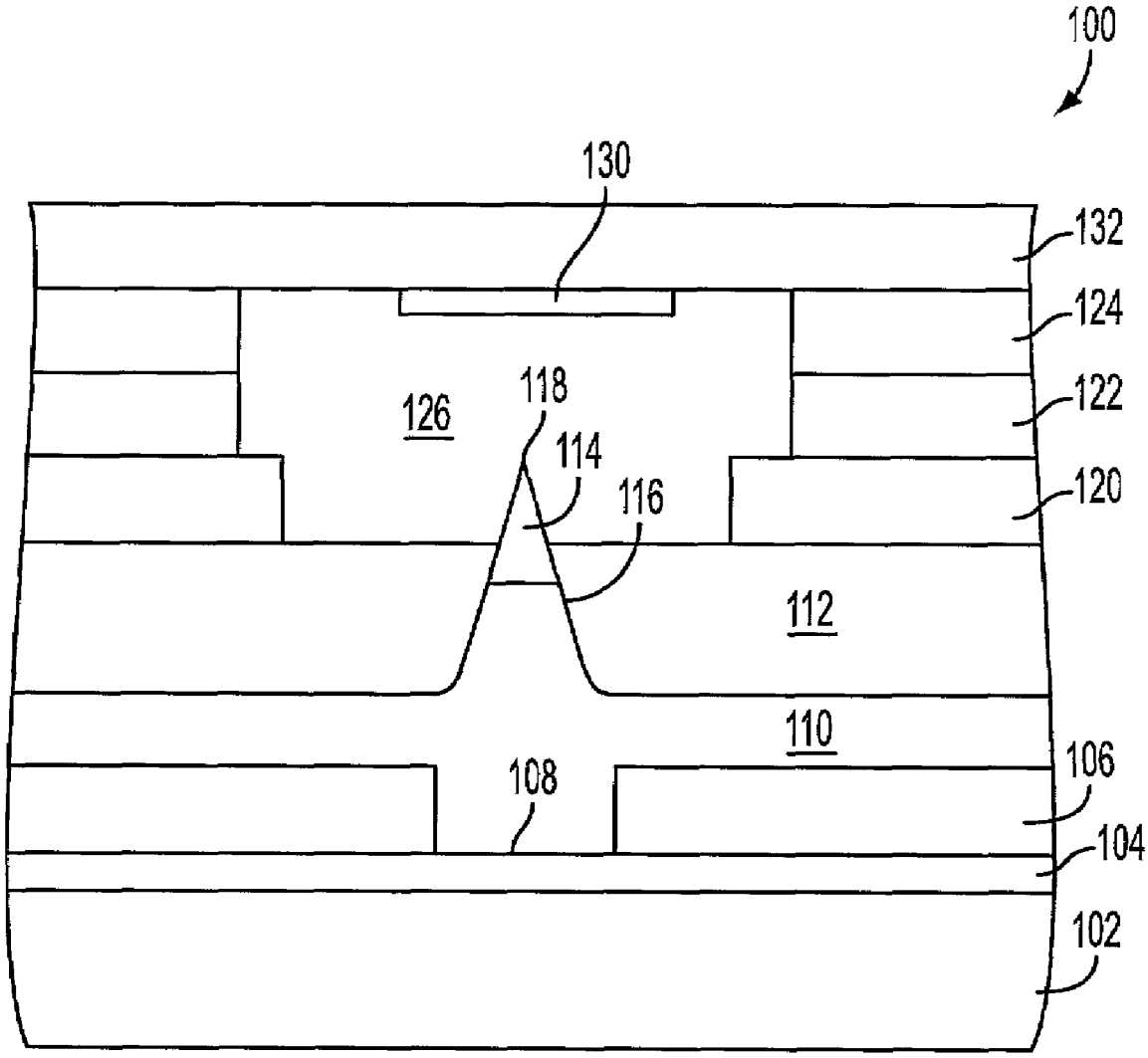
FIG. 2 is a cross sectional view of the device in FIG. 1 at a subsequent stage of processing.

Next, as shown in FIG. 2, layers 110 and 114 are etched to form a current emitter 116 in an extended shape. Preferably emitter 116 is formed in a conical shape, but other shapes can be formed as well.

To finish the construction of the FED device 100, silicon dioxide is deposited using PECVD processing to form a insulating layer 112 around the sides of the current emitter 116. The insulating layer 112 is provided around the sides of the current emitter 116 so that current does not radiate out of the sides of the current emitter 116 and provide cross-talk to nearby current emitters. Furthermore, this insulating layer 112 helps direct the current to the tip 118 of the current emitter 116 which is desired.

A grid layer 120 is then deposited using PECVD. The grid layer 120 is composed of amorphous silicon doped with phosphorus. Another metal layer 122 is deposited using DC magnetron sputtering on top of grid layer 120. Lastly, a passivation layer 124, containing nitride, is deposited on top of the metal layer 122. To ensure an opening for emission current to pass from the tip 118, an open area 126 is etched from the passivation layer 124 down to the insulating layer 112.

At this point native oxides are present in the tip 118 as a result of the silicon at tip 118 being exposed to the atmosphere. If left untreated, these natural oxides will reduce the emission current at the tip 118 approximately ten fold. To combat this problem, this invention, treats the tip 118 of FIG. 2 with a PECVD hydrogenation process and subsequently with a nitrogen plasma process while the FED device 100 is still in the PECVD chamber. The nitrogen plasma treatment should occur while the FED device 100 is still in the PECVD chamber to reduce the possibility of atmosphere contamination.

This PECVD hydrogenation is performed with about 1000 sccm silane gas flow, with the RF power set between about 200–300 watts, and the PECVD chamber pressure at about 1200 mtorr for a period of about 5 to 10 minutes. The nitrogen plasma treatment is performed with about 500 sccm NH3 (ammonia) gas flow, with the RF power set between about 300–400 watts, and the PECVD chamber pressure at about 1200 mtorr for a period of about 10 to 15 minutes. This treatment changes the chemical nature of the current emitter tip 118.

After the PECVD and nitrogen plasma treatment, a panel containing a plurality of FIG. 2 current emitters is heat sealed to a facing faceplate panel containing phosphors 130 with a top surface substrate 132, which oppose the current emitters 116 using conventional techniques under a temperature as high as 400–420 degrees Celsius. The resulting FED device has a lower work function and increased current emission as a consequence of the PECVD hydrogenation and nitrogen plasma treatment.

FIG. 4 illustrates, in a tabular format, the surface atomic concentrations of an oxygen, nitrogen and silicon for a conventional emitter tip without tip surface treatment in accordance with the invention (1) and with the surface treatment in accordance with the invention (2). It shows that the surface treatment of this invention greatly reduces the atomic concentration of silicon and oxygen on the tip (which can form silicon dioxide in the presence of heat). This data was derived by using x-ray photoelectron spectroscopy.

Figure 5:
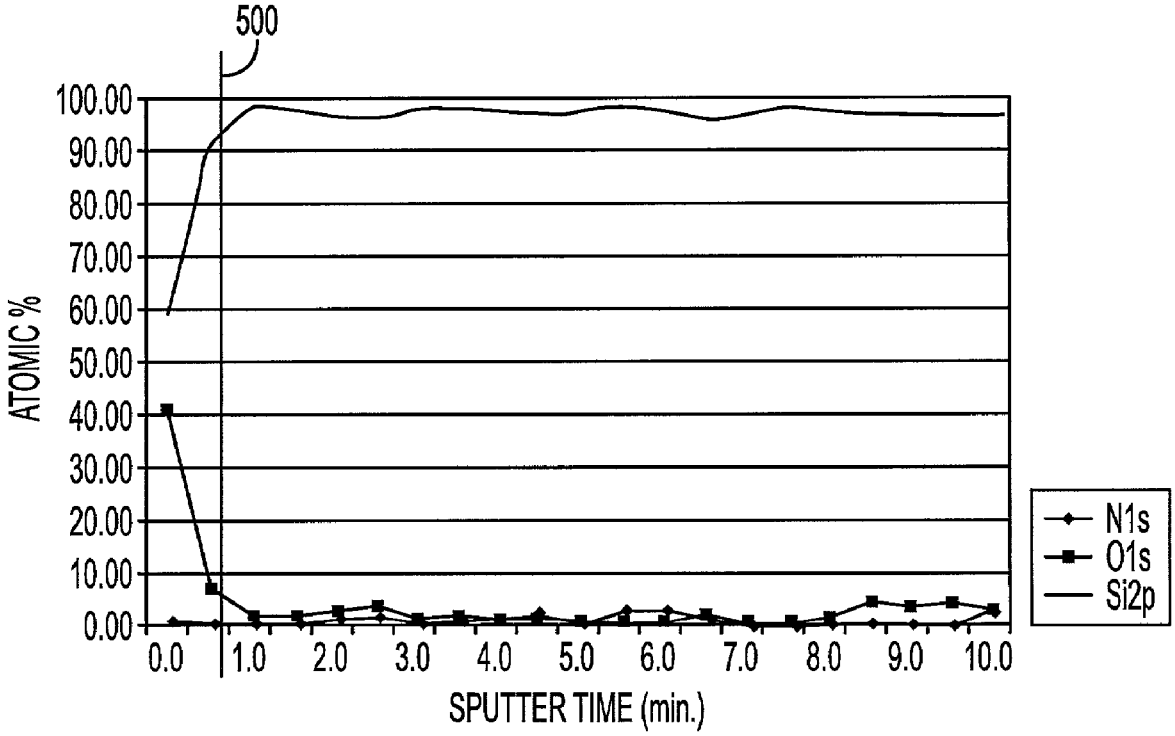
FIG. 5 is a graph plotting the oxygen, nitrogen and silicon concentrations of a FED tip after fabrication according to the prior art.
Figure 6:
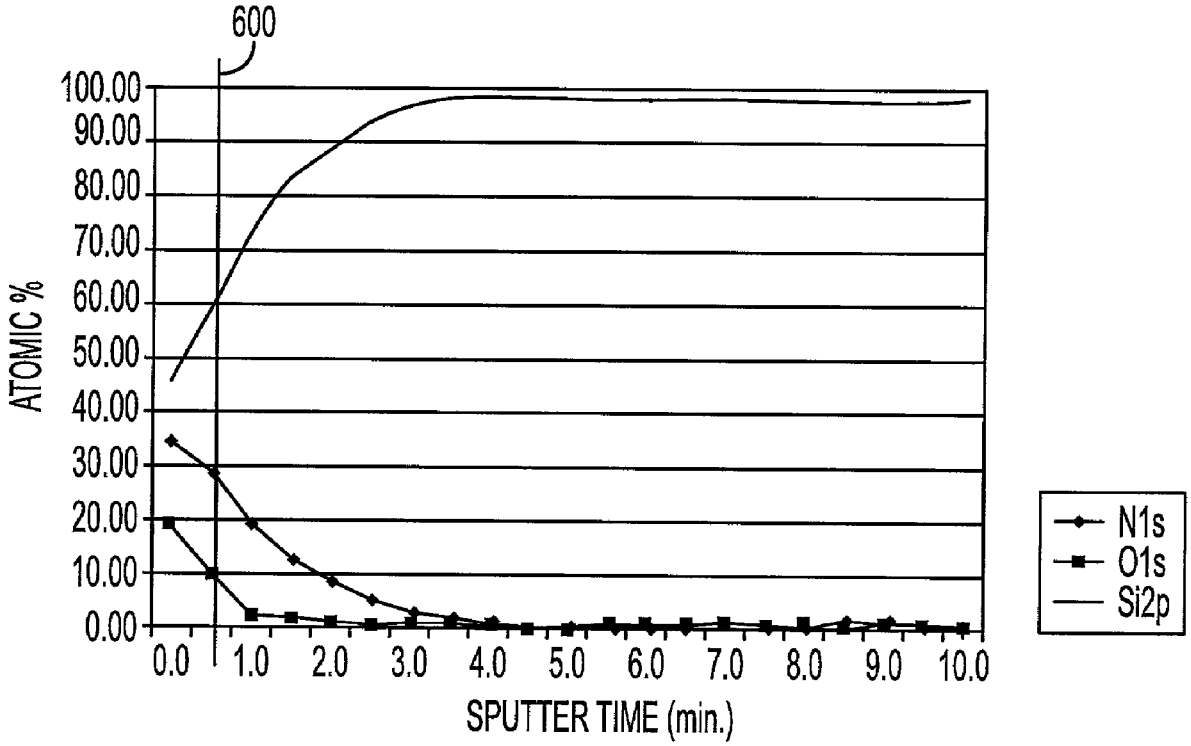
FIG. 6 is a graph plotting the oxygen, nitrogen and silicon concentrations of a FED tip after fabrication according to the present invention.

FIGS. 5 and 6 are graphs of the results of a x-ray photoelectron spectroscopy (XPS) analysis of the emitter tips. These graphs show the atomic percentages of nitrogen, oxygen, and silicon verses sputter time for a conventional emitter tip without surface treatment in accordance with this invention and for an emitter tip with tip surface treatment in accordance with this invention, respectively. These graphs were generated by the XPS inspection apparatus after the FED devices 100 were already fabricated. Thus, "sputter time" as illustrated in FIGS. 5 and 6 pertains solely to the sputter time of the XPS inspection apparatus not to sputter time in relation to the fabrication of the FED device 100.

A comparison of FIGS. 5 and 6, focusing on the data to the left of lines 500 and 600, shows that treatment in accordance with this invention does change the surface chemistry of the current emitter. The most obvious chemical changes being the reduction of oxygen and presence of nitrogen in FIG. 6. This confirms the data illustrated in FIG. 4.

Figure 3:
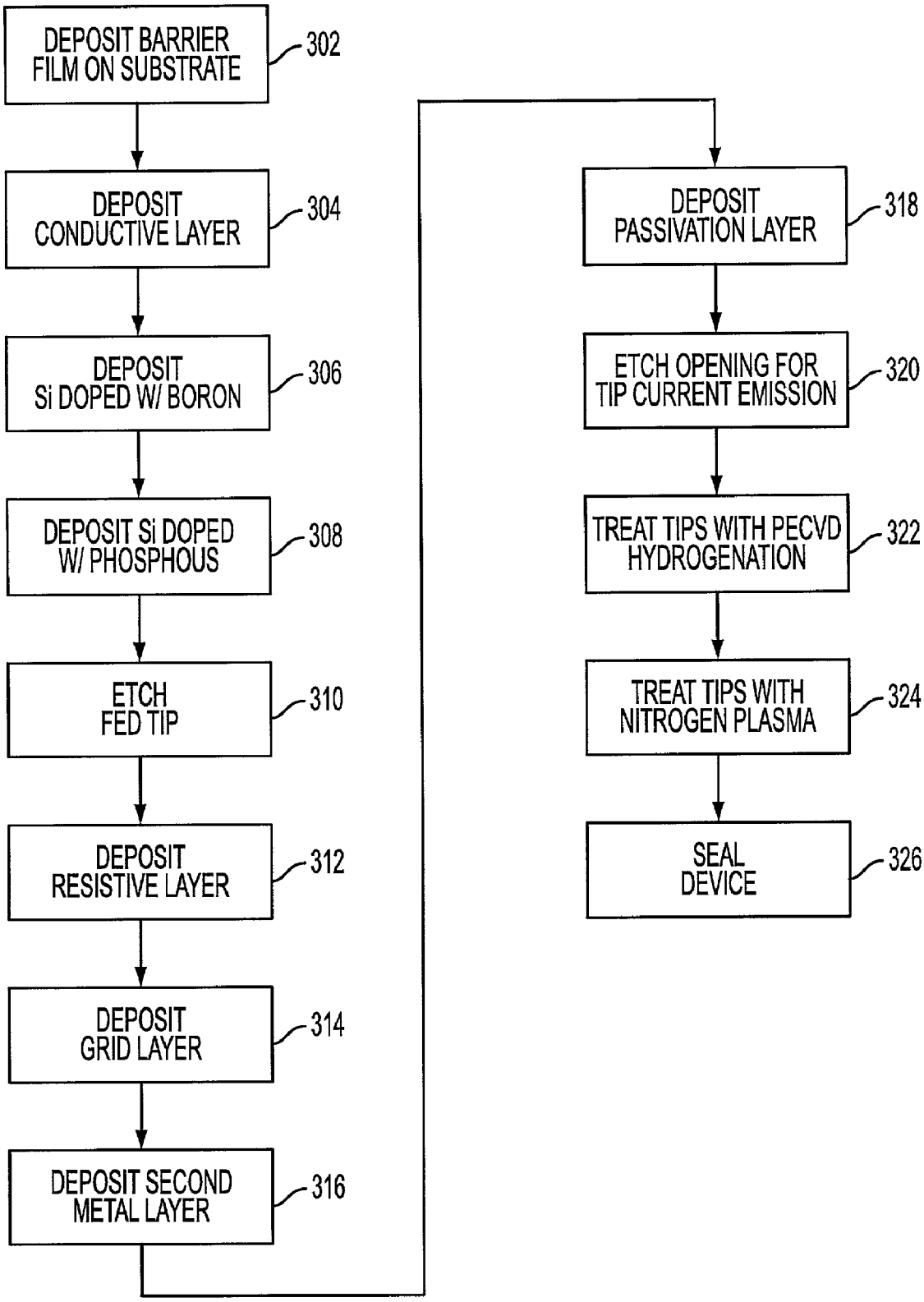
FIG. 3 is a flow chart illustrating the process steps in accordance with a preferred embodiment of this invention.

The overall process of the invention is illustrated in FIG. 3. The barrier film layer 104 is first deposited on the substrate 102 using PECVD processing 302. The conductive layer 106 is then deposited using DC magnetron sputtering, where patterning is included for the base of the current emitter 116 to be formed 304 and for electrode contact with the current emitters 116. The current emitter 116 is constructed by the deposition of silicon doped with boron 110, 306 and silicon doped with phosphorus 114, 308. The current emitter 116 is then etched forming a tip 118 at the top of the structure 310. The insulating layer 112 is then deposited using PECVD processing 312. Next, the grid 120 is deposited also using PECVD 314. A second metal layer 122, 316 and the deposit of a passivation layer 124, 318 complete fabrication of the structure. An area is then etch through the layers formed in steps 314 through 318, so that the current emission from the tip 118 can reach the upper surface of the FED device 100. The tip 118 is then treated with PECVD hydrogenation 322 followed by an infusion of nitrogen on the tip 324 while the tip 118 is still in the PECVD chamber. Lastly, a panel containing the formed FED device 100 is sealed under a high temperature 326 to a faceplate panel area containing phosphors 130, where the areas containing phosphors 130 are positioned to align with a respective current emitter.

It is to be understood that the above description is intended to be illustrative and not restrictive. Many variations to the above-described method and structure will be readily apparent to those having ordinary skill in the art. For example, the micropoint structures may be manufacture with more than one insulating layer.

Accordingly, the present invention is not to be considered as limited by the specifics of the particular structures which have been described and illustrated, but is only limited by the scope of the appended claims.

What is claimed as new and desired to be protected by Letters Patent of the United States is:

1. A method of treating at least one flat panel display current emitter, said method comprising:

a) exposing a native oxide-containing tip of said at least one current emitter to a hydrogenation process comprising plasma enhanced chemical vapor deposition conducted in the presence of a silane gas in a reaction chamber, wherein said plasma enhanced chemical vapor deposition process is conducted with a silane gas flow rate of about 1000 sccm, an RF power of about 200–300 watts, a chamber pressure of about 1200 mtorr, and a deposition period of about 5 to 10 minutes; and b) exposing said hydrogenation process-treated tip of the at least one current emitter to a nitrogen infusion process, wherein said hydrogenation process-treated and nitrogen-infused tip has a reduced atomic concentration of silicon and oxygen relative to the atomic concentration of said native oxide-containing tip.

2. A method as in claim 1, wherein said nitrogen infusion process is conducted in said reaction chamber following said plasma enhanced chemical vapor deposition process.

3. A method as in claim 2, wherein said nitrogen infusion process is conducted in the presence of ammonia gas.

4. A method as in claim 3, wherein said nitrogen infusion process is conducted with an ammonia gas flow rate of about 500 sccm, an RF power of about 300–400 watts, a chamber pressure of about 1200 mtorr and for a period of about 10 to 15 minutes.

5. A method as in claim 1, wherein said current emitter includes a base portion surrounded by an insulator and said current emitting portion extends from said insulator.

6. A method as in claim 1, further comprising:

performing steps (a) and (b) on a plurality of current emitters.

7. A method as in claim 6, further comprising:

sealing said plurality of current emitters in a field emission display device.

8. A method of fabricating a field emission device, said method comprising:

treating the tips of the current emitters of said field emission device with plasma enhanced chemical vapor deposition hydrogenation in the presence of a silane gas in a chamber, wherein said plasma enhanced chemical vapor deposition process is conducted with a silane gas flow rate of about 1000 sccm, an RF power of about 200–300 watts, a chamber pressure of about 1200 mtorr, and a deposition period of about 5 to 10 minutes; and treating said hydrogenation process-treated tips with nitrogen plasma while said tips are still in said chamber, wherein said hydrogenation process-treated and nitrogen plasma-treated tips have a reduced atomic concentration of silicon and oxygen relative to the atomic concentration of said tips prior to said treatment.

9. A method of treating at least one flat panel display current emitter, said method comprising:

a) providing at least one current emitter of doped silicon;

b) exposing at least a tip of said at least one current emitter to a hydrogenation process comprising plasma enhanced chemical vapor deposition conducted in the presence of a silane gas to form a hydrogenation process-treated tip of said at least one current emitter; and c) exposing said hydrogenation process-treated tip of said at least one current emitter to a nitrogen infusion process using an ammonia gas to form a treated current emission surface of said tip, said treated current emission surface having an oxygen surface atomic concentration smaller than the oxygen surface atomic concentration of the current emission surface prior to exposing said at least one current emitter to the hydrogenation process.

10. A method of treating at least one flat panel display current emitter, said method comprising:

a) providing at least one current emitter of doped silicon;

b) exposing at least a tip of said at least one current emitter to a hydrogenation process comprising plasma enhanced chemical vapor deposition conducted in the presence of a silane gas to form a hydrogenation process-treated tip of said at least one current emitter; and c) exposing said hydrogenation process-treated tip of said at least one current emitter to a nitrogen infusion process using an ammonia gas to form a treated current emission surface of said tip, said treated current emission surface having a silicon surface atomic concentration smaller than the silicon surface atomic concentration of the current emission surface prior to exposing said at least one current emitter to the hydrogenation process.

11. A method of treating at least one flat panel display current emitter, said method comprising:

a) providing at least one current emitter of doped silicon;

b) exposing at least a tip of said at least one current emitter to a hydrogenation process comprising plasma enhanced chemical vapor deposition conducted in the presence of a silane gas to form a hydrogenation process-treated tip of said at least one current emitter; and c) exposing said hydrogenation process-treated tip of said at least one current emitter to a nitrogen infusion process using an ammonia gas to form a treated current emission surface of said tip, said treated current emission surface having a nitrogen surface atomic concentration greater than the native nitrogen surface atomic concentration of the current emission surface prior to exposing said at least one current emitter to the hydrogenation process.

12. A method of fabricating a field emission device, said method comprising:

providing at least one current emitter formed of doped silicon;

providing a substrate having a phosphor coating in at least one region positioned to receive electrons emitted by said current emitter; and providing a treated current emission surface having an atomic concentration of oxygen smaller than the oxygen surface atomic concentration of said current emitter prior to treating said at least one current emitter, said treated current emission surface being formed by:

(a) exposing at least a portion of said at least one current emitter to a hydrogenation process in the presence of silane; and (b) exposing at least a portion of said at least one current emitter to a nitrogen infusion process.

* * * * *

UNITED STATES PATENT AND TRADEMARK OFFICE

CERTIFICATE OF CORRECTION

PATENT NO. : 7,101,586 B2
APPLICATION NO. : 10/120511
DATED : September 5, 2006
INVENTOR(S) : Kanwal K. Raina It is certified that error appears in the above-identified patent and that said Letters Patent is hereby corrected as shown below:

In Claim 11, column 6, line 38, “the native nitrogen” should read --the nitrogen--.

Signed and Sealed this

Fifth Day of December, 2006

JON W. DUDAS
*Director of the United States Patent and Trademark Office*